United States Patent [19]

Annoot

[11] Patent Number: 4,571,018

[45] Date of Patent: Feb. 18, 1986

[54] SEISMIC MARSH T-COUPLER WITH REMOVABLE POLARIZED CONNECTORS

[75] Inventor: Ira R. Annoot, Pasadena, Tex.

[73] Assignee: Houston Geophysical Products, Inc., Houston, Tex.

[21] Appl. No.: 610,472

[22] Filed: May 15, 1984

[51] Int. Cl.[4] ..... H01R 13/52; H01R 13/59

[52] U.S. Cl. ..... 339/60 R; 339/103 R; 339/151 C; 339/157 R

[58] Field of Search ..... 339/59 R, 59 M, 60 R, 339/60 C, 60 M, 89 R, 89 C, 89 M, 103 R, 103 C, 103 B, 115 R, 115 C, 116 R, 116 C, 157 R, 151 C; 174/93

[56] References Cited

U.S. PATENT DOCUMENTS

| | | | |
|---|---|---|---|
| 1,977,106 | 10/1934 | Wylie | 339/103 R |
| 2,331,409 | 10/1943 | Markey | 339/103 R |
| 3,567,843 | 3/1971 | Collins | 174/78 |
| 3,905,672 | 9/1975 | Anhalt | 339/103 R |
| 3,956,575 | 5/1976 | Sutherland | 339/103 R |

*Primary Examiner*—Neil Abrams

*Attorney, Agent, or Firm*—Michael P. Breston

[57] ABSTRACT

The T-coupler has a casing from which extends at least one sleeve having a tubular wall, a rear wall, a port, and a connector chamber formed between the rear wall and the port. First connector contacts are arranged on the rear wall of the sleeve. Conductors within the casing electrically interconnect the first contacts to provide polarized circuit paths therebetween. A connector element carries mating second contacts. A forwardly-tapering resilient sealing grommet and a forwardly-tapering anchoring grommet are provided in the connector chamber. A seismic leader cable extends through the longitudinal bores in the anchoring and sealing grommets. The conductors of the cable are electrically connected to respective ones of the second contacts in the connector. An end cap is adapted to become secured to the forward portion of the sleeve to thereby anchor the cable to the anchoring grommet, and to seal off the connector chamber against moisture penetration.

3 Claims, 14 Drawing Figures

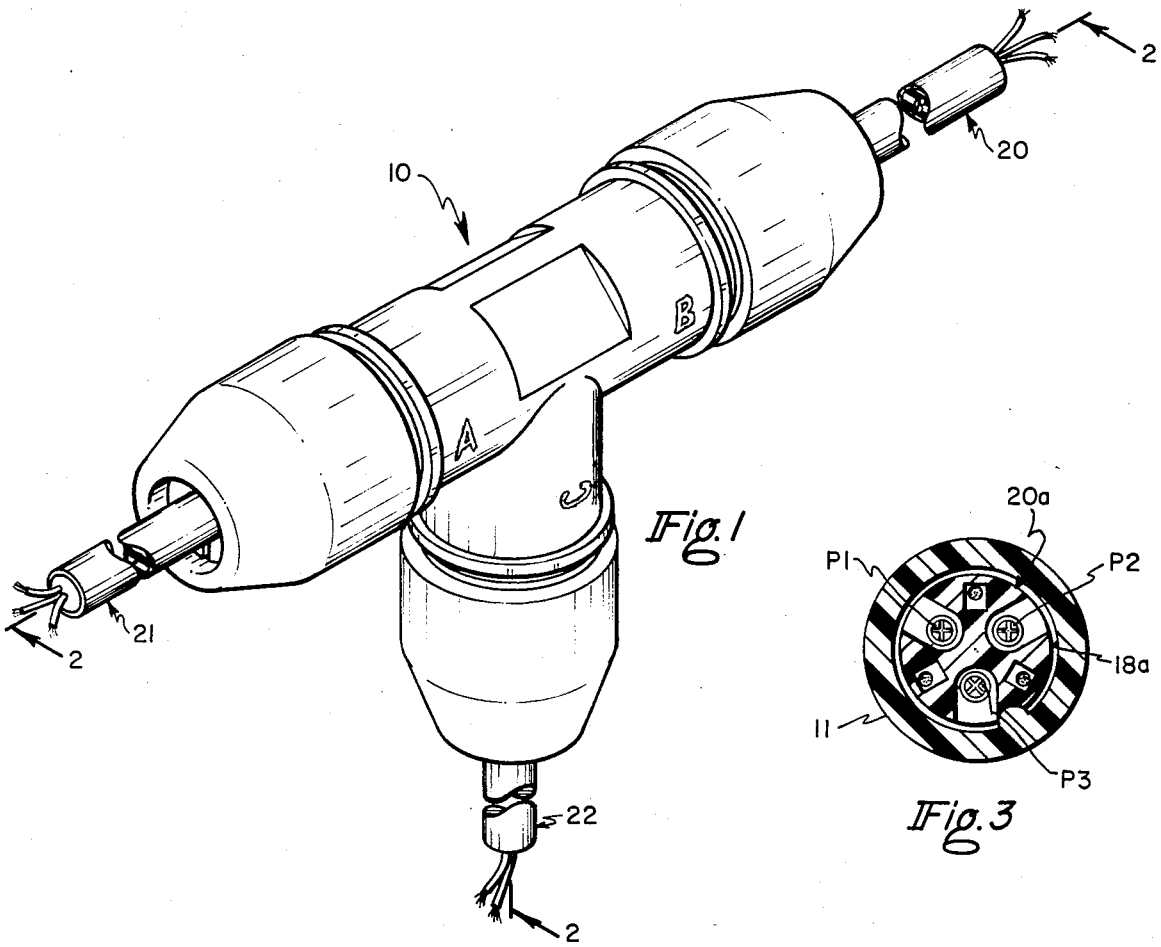
Fig. 1
Fig. 3
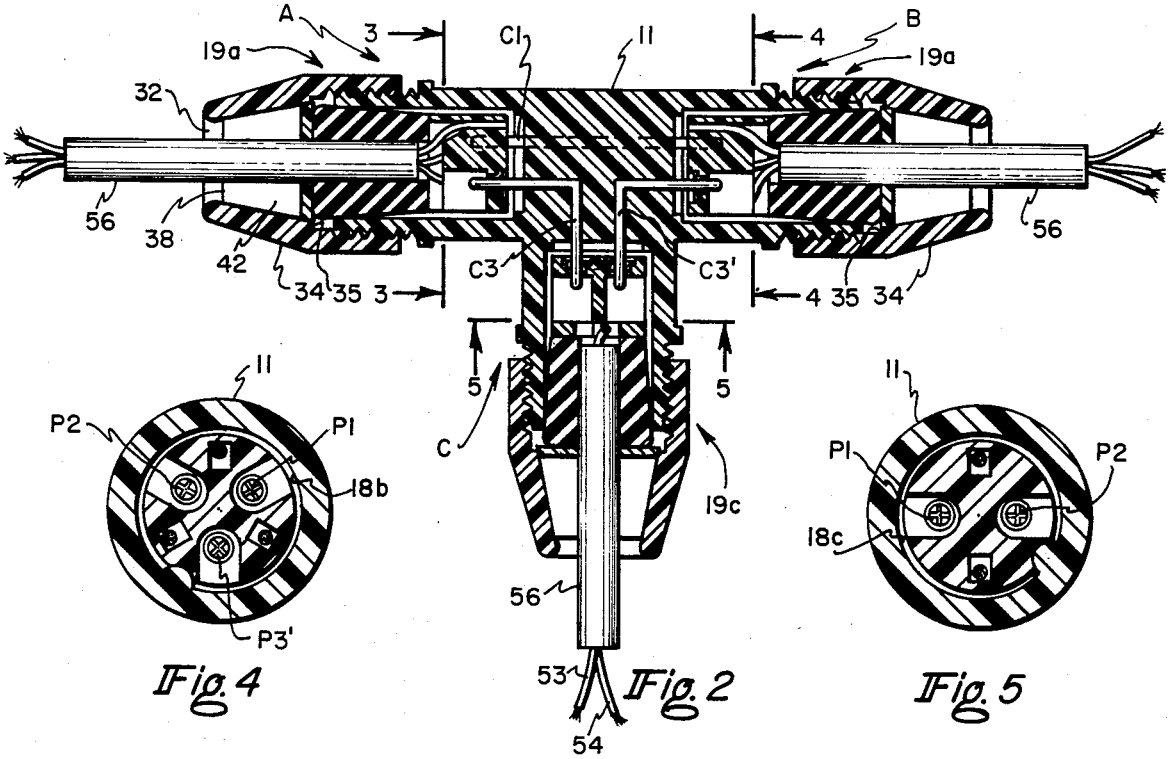
Fig. 4
Fig. 2
Fig. 5

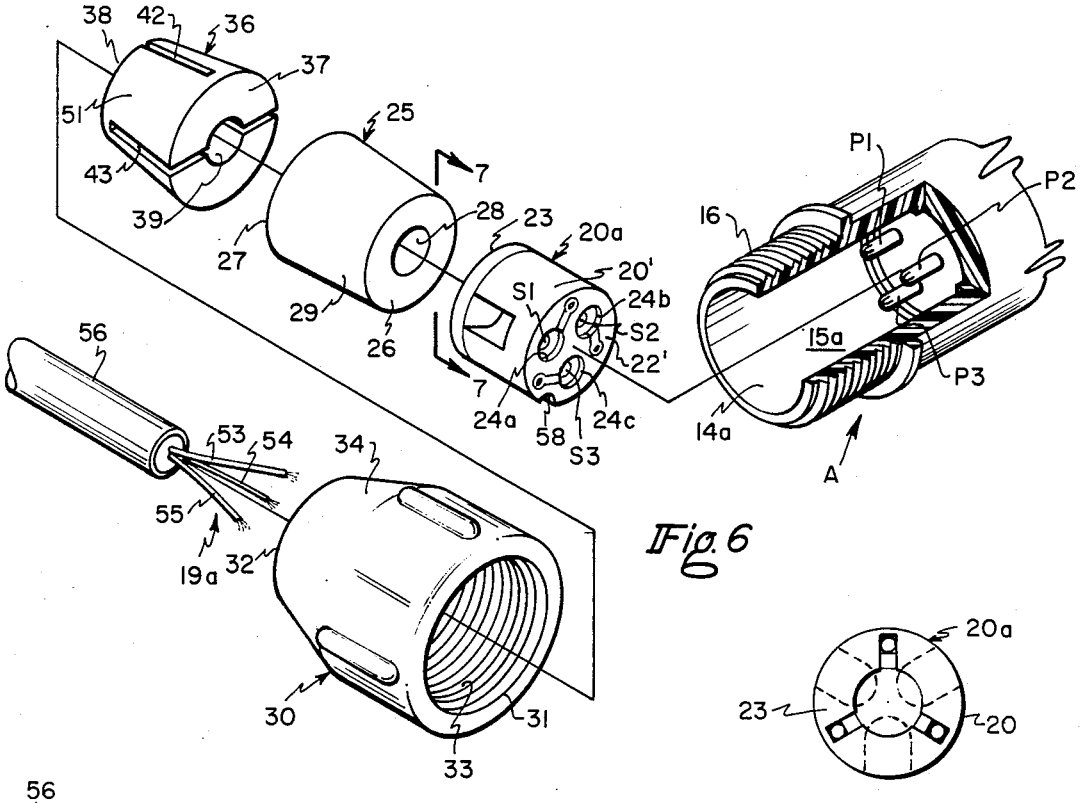
Fig. 6
Fig. 7
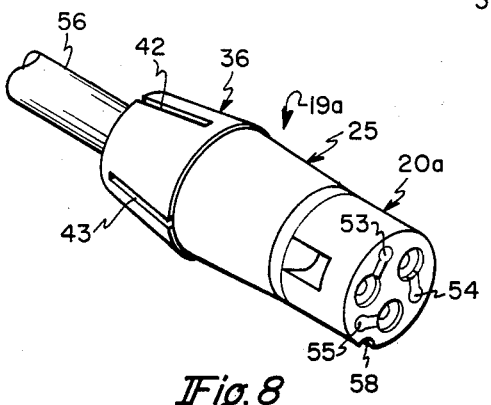
Fig. 8
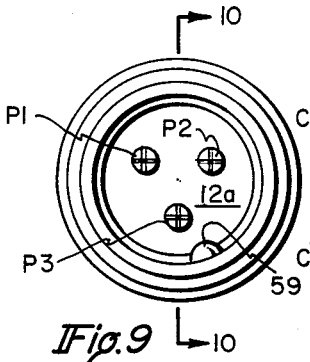
Fig. 9
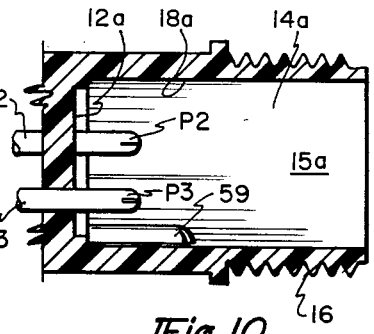
Fig. 10
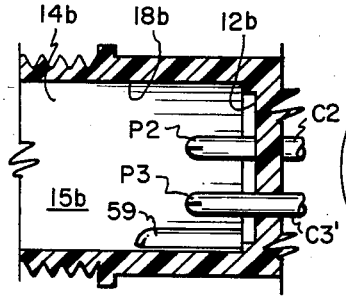
Fig. 12
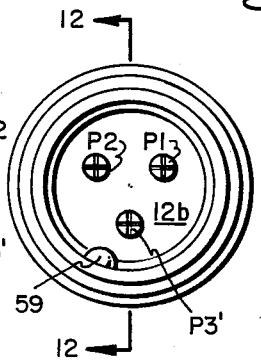
Fig. 11
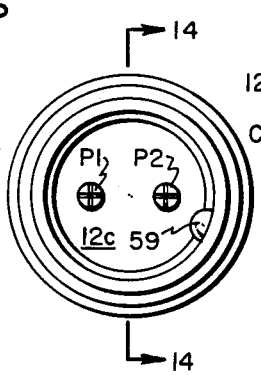
Fig. 13
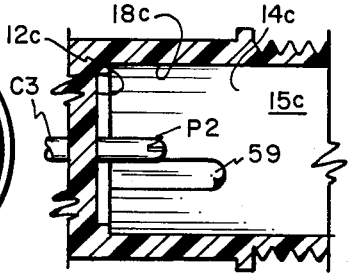
Fig. 14

SEISMIC MARSH T-COUPLER WITH REMOVABLE POLARIZED CONNECTORS

BACKGROUND OF THE INVENTION

1. Field of the Invention

This invention relates to marsh T-couplers especially adapted for use with seismic leader cables laid at the bottom of swampy terrains while conducting seismic prospecting.

2. Description of the Prior Art

A march "string" generally consists of a "thru" leader cable which makes the necessary electrical interconnections between spaced-apart "drop" leader cables. Each drop leader has at the end thereof one or more seismic detectors. The thru leader which is used to connect together the seismic detectors, i.e., the geophones and/or hydrophones, is generally a three-conductor cable and stretches the entire length of the marsh string, say 50 to 300 feet. The three-conductors are required to interconnect the drop leader's seismic detectors in series and/or parallel combinations, or to interconnect them in series on a marsh string that is "double ended", i.e., which has a connector at each end so that it can be connected into the recording instrument's "spread cable" from either end of the marsh string.

A "spread cable" usually consists of more than 50 wire pairs. Each wire pair collects the seismic data gathered by the land strings and/or marsh strings and transmits the collected data to the recording instruments. In a spread cable, a twisted pair of wires is employed for each separate channel of seismic data to be recorded. A seismic crew typically employs 48 or more separate seismic data channels.

In recent years, some spread cables have been replaced with telemetry systems, wherein the components of the recording system are dispersed over the line along which the seismic exploration is being conducted. A double-ended marsh string is then connected either to the spread cable of the recording system, or to the remote data acquisition units (RDAU) of the telemetry system.

Three-conductor thru leaders are primarily used: (1) when the individual marsh detectors, i.e., geophones and/or hydrophones, are to be connected in series-parallel combinations, or (2) when the detectors are to be connected in series and the string is to be double ended.

On the other hand, if all the marsh detectors are to be connected only in series, then a two-conductor thru leader can be used, and the marsh string can be single ended because it needs to be connected to the recording system only from one point.

It is possible to fabricate a double-ended marsh string utilizing only two conductors in the thru leaders, but only when the marsh detectors are connected in parallel. However, this condition is not often encountered.

Since marsh detectors are only two terminal devices, no more than two conductors are needed in a drop leader cable to electrically connect the output terminals of the detector to the conductors in the thru leader cable.

My novel marsh T-coupler now makes it possible to easily and economically fabricate marsh strings and/or to replace the seismic detectors thereon. The advantages of my invention will be better appreciated from a short review of techniques which are commonly used for fabricating a marsh T. There are three commonly used methods for fabricating a marsh T.

The first method requies that the T-connection, i.e., the interconnection between the conductors of the drop leader and the conductors of the thru leaders be totally encapsulated. This is done at the factory by molding a complete cover of neoprene or urethane over the T-connection. Unfortunately, in the harsh environment in which marsh strings are used, both the thru leaders and drop leaders often become cut. When that happens, electrical leakage occurs between the leaders' conductors and ground. Since a molded T-connection forms an integral and permanent part of the marsh string, it is difficult to open in the field the T-coupler for replacement of the particular leader cable which is cut. Hence, adequate servicing of such marsh strings in the field is virtually impossible.

The second method involves the use of two halves of a T-casing which is usually made of hard plastic. The interconnection between the conductors of the thru leader and the drop leader are made within one half of the T to which is then secured to the other half of the T. The void left inside the T-casing is then filled with a potting compound. This method has the advantage of being much cheaper than the first method. But, field servicing is still difficult because the employed potting compound strongly adheres to the inner walls of the T-casing. Consequently, the field crew finds it difficult to take apart such a T-casing, then to make the necessary interconnections, and finally to properly and completely fill the void in the T-casing with a potting compound. In an improperly potted T-casing, packets of voids remain which will tend to allow moisture penetration leading to electric leakage between the leaders' conductors and ground.

Finally, the third method for making a marsh T is described in U.S. Pat. No. 3,956,575. The patented marsh T has a cylindrical casing which defines a chamber and a single entry port. Solder balls on a disc inside the chamber anchor the bare ends of the interconnected conductors. Solder balls require soldering irons and consume time of skilled technicians who usually are not available to a seismic crew. To waterproof the chamber in the casing, its single entry port is sealed with a grommet made of a resilient material. This grommet has three axial bores for accepting therethrough the two thru leaders and the single drop leader which are to be interconnected. Each leader has a flexible external protective jacket. A cap is threadedly connected to the open end of the casing to compress and to hold the resilient grommet in its sealing position.

Under field use, frequent pulling on the drop leaders is often unavoidable, for example, in order to extract a geophone at the end of a drop leader which has been planted deep into the marsh. Such frequent pulling eventually causes the diameters of the outer jackets of the pulled drop leaders to decrease. The reduced-diameter jackets will tend to slide out from their respective sealing grommets. When that happens, moisture starts penetrating inside the chamber of the T-casing from which the jacket was pulled out. Since water is a better conductor of electricity than air is over dry earth, such moisture penetration into the chamber, through the bore in the sealing grommet from which the cable jacket was pulled out, will eventually short circuit, inside the leaky chamber, the interconnected conductors to each other and/or to ground. As a result, the desired seismic signals generated by the geophones and/or hydrophones will become short-circuited to ground giving rise to seismic map sections which will be difficult, if not impossible, to interpret.

There has been a need, therefore, for the seismic leader cables to become interconnected in a completely moisture-proof manner, even when the drop leaders are frequently pulled upon. While the marsh T described in U.S. Pat. No. 3,956,575 requires no potting and can be opened easily for testing or repair, nevertheless, field repair and installation are still relatively difficult because the patented T-coupler requires stripping the insulation from the ends of the conductors, arranging the conductors in their proper sequence, interconnecting the bare ends of the conductors, and then soldering balls onto the interconnected bare ends, all of which require time, skilled laber, and are difficult to execute in the field.

My invention will eliminate the above described and other known problems and shortcomings of the prior art techniques used to manufacture marsh T-couplers, to install marsh geophones and/or hydrophones on drop leader cables, and to assemble them into marsh strings.

A most important advantage of my invention is that it allows the component parts of a marsh string to be prefabricated. Once prefabricated, the electrical interconnections between the thru leaders and drop leaders can be made by means of polarized plug-in connectors without the use of soldering irons. Plug-in connections can be made quickly and easily by simply screwing on a cap which secures the mating connector parts together. Thus, field testing and replacement of drop leaders and their detectors is possible with my invention without using soldering irons, special tools, and special skills.

My invention further provides a marsh T-casing having three entry ports, each having a separate sealing grommet, whereas in the marsh T, described in U.S. Pat. No. 3,956,575, a single entry port is used having a single grommet for the porpose of sealing off all three leader cable entries into the marsh T. My invention uses a separate anchor for each leader jacket which prevents the above-described, jacket-diameter-reduction problem and the ensuing loss of imperviousness.

Prior to my invention, the need to completely waterproof the marsh T on one hand, and the need for rapidly connecting and disconnecting the leader cables to the marsh T on the other hand, appeared to be mutually inconsistent. Whereas the prior art requires solder balls and operator skill to accomplish the proper electrical interconnections between the conductors of the thru leaders and the drop leaders, in my invention the proper electrical connections are molded into the marsh T itself. In assembling the thru leaders and drop leaders together with the marsh T, uniquely polarized plug-in connectors are used. In this manner, human errors are completely eliminated.

In the field it is often required to change the lengths of the thru and drop leaders because the intervals between the geophones and/or hydrophones are determined by the lengths of the thru leaders between consecutive marsh T-couplers. An additional advantage of my invention lies in the flexibility it provides for changing the interval lengths between the marsh detectors, and for changing the lengths of the leader cables themselves. In the prior art, changes involving thru leader or drop leader length could only be accomplished by first rebuilding the marsh T-couplers involved, and then reassembling the entire marsh string. My invention makes it easy to change the lengths of the thru leaders and/or drop leaders. To change a leader, it is only necessary to unscrew the cap, remove the leader-connector to be changed, replace it with the desired length leader-connector and screw the cap back onto the T-casing.

Also, in the field defective marsh geophones and/or hydrophones must be replaced from time to time. My invention allows the drop leader with the defective detector to be simply and easily removed from the marsh T-casing and then to be replaced with a drop leader that has at one one my plug in connector and at the opposite end thereof a good geophone or hydrophone.

Thus, it may be fairly stated that while several types of marsh T-couplers for joining leader cables are already known and used, waterproofing of the known marsh T-couplers is rather difficult, the jackets of the leader cables are not sufficiently anchored, and quick connect/disconnect of the leader cables is not possible.

Accordingly, my invention provides a new and improved seismic marsh T-coupler which meets a number of rather specific requirements, specifically to interconnect/disconnect the leaders without the need for soldered connections, and to easily interchange different length leaders. The leaders according to my invention remain interconnected within the T-casing in a sufficiently moisture-proof and disconnection-resistant manner because the leaders' outer jackets become adequately anchored to the body of my T-coupler. In addition, simple mechanical polarizing means are provided for each connector to prevent accidental misconnections between the wires of the interconnected leader cables.

SUMMARY OF THE INVENTION

The novel T-coupler for leader cables has a casing from which extends at least one sleeve having a tubular wall, a rear wall, a port, and a connector chamber formed between the rear wall and the port. First contacts are arranged on the rear wall of the sleeve in a predetermined configuration. Conductors within the casing electrically interconnect the first contacts to provide polarized circuit paths therebetween. A connector element is slidable within the chamber. Second contacts are arranged on the connector in a configuration that matches the configuration of the first contacts. The first and second contacts are adapted to operatively mate with each other. A resilient sealing grommet, which is positioned in back of the connector, has an axial bore. An anchoring grommet, which is positioned in back of the sealing grommet, has a rear wall, a front wall, and an axial bore therebetween. A leader cable, which has an outer protective flexible jacket and internal insulated conductors, extends through the longitudinal bores in the anchoring and sealing grommets. The conductors of the cable are electrically connected to respective ones of the second contacts in the connector. An end cap, which has a rear portion, a forward portion, a front end opening, and a rear end opening, is adapted (1) to become secured to the forward portion of the sleeve to thereby exert pressure on the anchoring grommet, whereby the portion of the cable's outer jacket within the anchoring grommet's axial bore becomes anchored to the anchoring grommet, and (2) to exert pressure against the rear wall of the sealing grommet, to thereby seal off the connector chamber in the sleeve against moisture penetration.

In a preferred embodiment, there is provided a new and improved marsh T-coupler for leader cables which has a main body from which extend spaced-apart tubular sleeves. Each sleeve has a tubular wall with an outer threaded wall portion, a rear wall, a front port, and a connector chamber which is defined between the rear wall and the front port. Polarized, parallel, connector prongs extend longitudinally and forwardly from the rear wall of the sleeve. The prongs are insulated from each other and are arranged in a predetermined polarized configuration. Conductors within the casing electrically interconnect the prongs to provide polarized circuit paths therebetween.

Operatively associated with each connector chamber within the sleeve is a connector assembly which includes a connector element that is slidable within the chamber. The connector element has a front wall, a back wall, and polarized axial bores. Conductor sockets extend inwardly from the connector's front wall. The sockets are arranged in parallel, insulated relation and in a configuration that corresponds to the configuration of the prongs. The prongs and the sockets are adapted to operatively mate with each other.

A resilient, forwardly-tapering sealing grommet is positioned in back of the connector. The sealing grommet has a front wall, a rear wall, and an axial bore therebetween.

A hollow end cap, which has a rearwardly-tapering, unthreaded rear portion, an inwardly-threaded cylindrical forward portion, a front end opening, a rear end opening, and an inner annular shoulder, is positioned in back of an anchoring grommet. The forward end opening of the cap has a larger diameter than the diameter of its rear end opening.

The anchoring grommet is positioned in back of the sealing grommet. The anchoring grommet has a rear wall, a front wall, and an axial bore therebetween. The cross-sectional area of the rear wall in the anchoring grommet is slightly larger than the cross-sectional area of the rear end opening in the end cap. The outer wall of the anchoring grommet tapers from its front wall to its rear wall. A longitudinal center cut extends inwardly both from the front end wall and from the rear end wall of the anchoring grommet. These two cuts lie in mutually perpendicular planes.

A seismic leader cable, that has an outer protective flexible jacket and internal insulated conductors, extends through the longitudinal bores in the anchoring and sealing grommets. The diameter of the jacket is slightly larger than the diameter of the bore in the sealing grommet to provide a snug or compressed fit therebetween. The insulated conductors of the leader cable extend through the polarized bores in the connector, and the bare ends of the conductors are electrically connected to respective ones of the connector's sockets. The tapered portion of the cap has substantially the same taper as that of the anchoring grommet, whereby when the cap is threadedly secured to the threaded forward portion of the sleeve, pressure becomes exerted on the tapering outer wall of the anchoring grommet to thereby reduce the diameter of the axial bore in the anchoring grommet. In this manner, the portion of the cable's outer jacket, within the anchoring grommet's axial bore, becomes anchored to the anchoring grommet. Simultaneously, the anchoring grommet exerts pressure against the rear wall of the sealing grommet to seal off the sleeve's port, as well as the axial bore in the sealing grommet, thereby substantially fully waterproofing the connector chamber in the sleeve.

BRIEF DESCRIPTION OF THE DRAWINGS

FIG. 1 is a view in perspective of a preferred embodiment of a marsh T-coupler in accordance with this invention having three sleeves A–C;

FIG. 2 is a sectional view taken on line 2—2 of FIG. 1;

FIGS. 3–5 are sectional views taken along lines 3—3, 4—4, and 5—5 on FIG. 2, respectively;

FIG. 6 is an exploded view of a connector assembly which can be coupled to sleeve A;

FIG. 7 is a sectional view taken on line 7—7 of FIG. 6;

FIG. 8 is a perspective view of the assembled connector shown in FIG. 6;

FIG. 9 is an end view of sleeve A shown in FIG. 6

FIG. 10 is a view in section taken along line 10—10 on FIG. 9;

FIG. 11 is an end view of sleeve B shown in FIG. 2;

FIG. 12 is a view in section taken along line 12—12 on FIG. 11;

FIG. 13 is an end view of sleeve C shown in FIG. 2; and

FIG. 14 is a view in section taken along line 14—14 on FIG. 13.

DESCRIPTION OF A PREFERRED EMBODIMENT

To simplify the description, the same reference characters will be used to describe the same parts whenever possible.

My improved marsh T-coupler, generally designated as 10, is adapted to interconnect thru leaders 20–21 and drop leader 22. Coupler 10 comprises a main body 11, which is illustrated as having three, spaced-apart, circular inner end walls **12*a*–12*c* from which outwardly extend tubular sleeves A–C, having circular front ports 14*a*–14*c* and inner cylindrical walls 18*a*–18*c*, respectively. Ports 14*a*–14*c* are concentric with their corresponding circular end walls 12*a*–12*c*, respectively. Sleeves A–C respectively define connector chambers 15*a*–15*c* between their end walls 12*a*–12*c* and their ports 14*a*–14*c***. Sleeves A–C are similar in construction except for the number of connector contacts therein.

Sleeve A has a forward, outwardly-threaded wall portion 16 around its circular port **14*a*. First connector contacts, such as three parallel prongs P1–P3, extend longitudinally and forwardly from end wall 12*a*. Sleeve B also has three such prongs P1, P2 and P3' which extend from end wall 12*b*, and sleeve 13*c* has only two such prongs P1–P2 which extend from end wall 12*c***. The prongs in each sleeve are insulated from each other and are arranged in a predetermined polarized configuration, that is, each prong is assigned to become connected only to a particular mating connector contact and hence only to a particular conductor in a particular leader cable.

Conductors C1–C2 within the coupler body 11 electrically interconnect the prongs P1–P2 of sleeves A–B to provide polarized circuit paths therebetween. Conductors C3'–C3 interconnect the prongs P1–P2 in sleeve C to prongs P3'–P3 in sleeves B and A, respectively.

Sleeves A–C and their respective connector chambers **15*a*–15*c* are adapted to receive connector assemblies 19*a*–19*c*, respectively. Since all the connector assemblies are similar in construction, except for the number of connector contacts, only a single connector assembly, say 19***a*, will be described in detail.

Connector assembly 19*a* has a plug-in connector element 20*a* which loosely slides within its connector chamber 15*a* in sleeve A. The body of connector element 20*a* has an outer cylindrical wall 20', a forward circular end wall 22', a rear end wall 23, and three longitudinal bores 24*a*–24*c* between end walls 22' and 23. Extending inwardly and rearwardly from the forward wall 22' are second connector contacts, such as sockets S1–S3, which are arranged in parallel, insulated relation and in a polarized configuration that matches the polarized configuration of their mating first connector contacts or prongs P1–P3.

A resilient, forwardly-tapering sealing grommet 25 has a forward circular wall 26, a rear circular wall 27, an axial bore 28 therebetween, and an outer conical wall 29 which tapers forwardly from end wall 27 to end wall 26.

A hollow end cap 30 has two circular end openings; its forward opening 31 has a larger diameter than the diameter of its rear opening 32. Cap 30 has an inwardly-threaded, forward cylindrical portion 33, a rearwardly-tapering portion 34, and an inner, annular shoulder 35 (FIG. 2) therebetween.

An anchoring grommet 36, made of a relatively rigid material, has a circular front wall 37, a circular rear wall 38, and an axial bore 39 therebetween. Its outer conical wall 51 tapers rearwardly from its front wall 37 to its rear wall 38. The cross-sectional area of its rear end wall 38 is slightly larger than the cross-sectional area of the rear opening 32 in cap 30. Anchoring grommet 36 has two longitudinal center cuts: one cut 42 which extends inwardly from end wall 38, and another cut 43 which extends inwardly from end wall 37. These cuts 42 and 43 lie in mutually perpendicular planes.

Each one of the two thru leaders 20–21 has three insulated conductors 53–55 and an outer flexible protective jacket 56. The drop leader 22 has only two conductors 53–54. Each leader extends through the axial bores 28 and 39 in the sealing and anchoring grommets 25 and 36, respectively. The diameters of bores 28 and 39 are slightly smaller than the outer diameter of jacket 56 to provide a snug or compression fit therebetween. Polarized conductors 53–55 extend through the polarized longitudinal bores 24*a*–24*c* in connector 20*a*, and the bare ends of these conductors are soldered to their respective connector sockets S1–S3.

The tapered rear portion 34 of end cap 30 preferably has the same angle of taper as that of anchor grommet 36. Accordingly, when cap 30 becomes fully threaded onto the forward threaded portion 16 of its mating sleeve A, pressure becomes exerted on the tapering wall 51 of anchoring grommet 36. The two perpendicular cuts 42–43 allow the diameter of bore 39 to become reduced in response to the pressure being applied by end cap 30 when it is being screwed upon sleeve A, thereby anchoring the portion of the outer jacket 56 of thru leader 20, which lies within bore 39, to the rigid body of anchoring grommet 36 and through it to the casing's body 11.

The anchoring grommet 36, in turn, exerts pressure against the rear wall 27 of the sealing grommet 25 to seal off the port 14*a* in sleeve A, as well as the axial bore 28 of sealing grommet 25. In this manner connector chamber 15*a* becomes completely moistureproof.

Mechanical polarizing means, such as a longitudinal notch 58 at a predetermined angular position on the outer cylindrical wall 20' of connector 20*a*, together with a mating longitudinal ridge 59 in the cylindrical chamber 15*a* of sleeve A, ensure that only prongs P1–P3 of chamber 15*a*can mate with sockets S1–S3 of connector 20*a*, respectively. The sockets S1–S3 of connector 20*a*, therefore, accept for quick connect/disconnect their mating polarized prongs P1–P3, without there ever being a possibility of contact connection error.

Since a similar description would apply to the two other connector assemblies 20*b* and 20*c*, it is not believed necessary to repeat it for the sake of brevity. The number of sleeves in coupler 10 and the number of connector contacts in each sleeve can vary depending on the number of conductors which exist in the leaders that are to be interconnected by the marsh coupler 10.

For example, a modification of the above-described marsh T-coupler 10 also permits its use as a marsh splice. For that purpose, during manufacturing, sleeve C of coupler 10, which was provided for connecting to drop leader 22, could be eliminated from the T-coupler 10.

The structure that would be left would be cylindrically-shaped rather than T-shaped. This cylindrically-shaped structure could be used advantageously as a splice for marsh strings. The advantages of my invention which benefits my marsh T will also benefit my marsh slice. For instance, my marsh splice will allow users to lengthen the drop leader and/or the thru leader by simply adding a length of leader using my marsh splice rather than replacing an entire length of leader. Thus my marsh splice, when used in connection with my marsh T, will increase the flexibility of the marsh string with regard to leader lengths, and will make it possible to use a shortened length of leader which might otherwise be scrapped.

Also, it may be desirable to fabricate marsh strings made up of shorter leader segments coupled together with my marsh splices, in this manner, when a section of leader becomes damaged, then the needed section of leader to be replaced would be shorter. Also, the thru leader or drop leader lengths can be easily shortened by removing a leader section from my marsh splice. It is currently the normal practice to fabricate a marsh string with the longest thru leader and drop leader lengths that will be required in use. When it is desired to use shorter lengths, the extra leader length is simply wrapped and taped into a coil. Even though having to carry an unneeded coil of leader is undesirable, now users have no practical choice to do otherwise.

My invention eliminates this problem and allows to outfit a seismic crew with different thru and drop leader lengths which are intended to plug directly into my T-couplers, or to outfit the crew with shorter lengths of leader which are joined together with my marsh splices. Each polarized connector assembly at the end of a leader is suitable for mating with either my T-coupler or with my marsh splice. This feature further increases the flexibility of fabricating marsh strings following the teachings of my invention.

Other advantages and modifications will readily suggest themselves to those skilled in the art, and all such are intended to be covered by the attached claims.

What is claimed is:

1. A coupler for seismic leader cables comprising:

(1) a coupler body from which extend at least a pair of sleeves, each sleeve having a tubular, outwardly-threaded front wall portion, an inner rear wall, a front port, and a connector chamber defined between the rear wall and the port; first connector contacts arranged on said rear wall in a predetermined polarized configuration; and spaced-apart conductors within the coupler body electrically interconnecting said first contacts to provide permanent polarized circuit paths between said sleeves;

(2) each sleeve operatively receiving a connector assembly, said assembly including:

(a) a connector element, second connector contacts arranged on said connector element in a configuration that corresponds to the configuration of said first contacts, said first and said second contacts being adapted to become operatively interconnected to each other;

(b) a resilient sealing grommet having a forwardly-tapering outer wall, a front wall, a rear wall, and an axial bore extending between its front and rear walls;

(c) an anchoring grommet having a rearwardly-tapering outer wall, a rear end wall, a front end wall, and an axial bore therebetween, a longitudinal center cut extending inwardly both from the anchoring grommet's front end wall and from its rear end wall, and said cuts lying in mutually perpendicular planes, said sealing grommet being positioned between said connector element and said anchoring grommet;

(d) a leader cable having an outer flexible jacket and internal insulated conductors, said cable extending through the longitudinal bores in the sealing grommet and anchoring grommets, and the conductors of the cable being electrically connected to respective ones of said second contacts; and (e) an end cap having an internally-threaded front portion, a rearwardly-tapering rear portion, a front end opening, and a rear end opening, said end cap upon being threadedly secured to said front portion of said sleeve exerting pressure on the anchoring grommet to thereby cause (i) the outer wall of said sealing grommet to seal off the connector chamber against outside moisture penetration, (ii) the diameter of the bore in the anchoring grommet to become reduced, and (iii) the portion of the cable's outer jacket, contained within the anchoring grommet's axial bore, to become anchored to said coupler body body.

2. The coupler of claim 1, wherein said connector element having polarized axial bores;

said first contacts are parallel, conductor prongs extending longitudinally and forwardly from said rear wall of said chamber;

said connector element is slidable within said connector chamber;

said second contacts are sockets extending rearwardly from the front wall of said connector element;

said conductors in said cable extending through said bores in said connector; and said tapered portion of said end cap having substantially the same taper as that of said anchoring grommet.

3. A marsh T-coupler for seismic leader cables having a coupler body from which extend spaced-apart tubular sleeves, each sleeve having a tubular, outwardly-threaded front wall portion, an inner rear wall, a front port, and a connector chamber defined between the rear wall and the port;

polarized, parallel, prongs extending longitudinally and forwardly from the rear wall of the sleeve, the prongs being insulated from each other and arranged in a predetermined polarized configuration;

conductors within the coupler body which electrically interconnect the prongs to provide polarized circuit paths therebetween;

a connector slidable within the connector chamber, the connector having a front wall, a back wall, and polarized longitudinal bores;

connector sockets extending rearwardly from the front wall of the connector, the sockets being arranged in parallel, insulated relation, and in a configuration that corresponds to the configuration of the prongs;

a resilient sealing grommet having a forwardly-tapering outer wall, a front wall, a rear wall, and an axial bore extending between its front and rear walls;

(e) an end cap having an internally-threaded front portion, a rearwardly-tapering rear portion, a front end opening, and a rear end opening;

(c) an anchoring grommet having a rearwardly-tapering outer wall, a rear end wall, a front end wall, and an axial bore therebetween, a longitudinal center cut extending inwardly both from the anchoring grommet's front end wall and from its rear end wall, and said cuts lying in mutually perpendicular planes, said sealing grommet being positioned between said connector element and said anchoring grommet;

a seismic leader cable having an outer protective, flexible jacket and internal insulated conductors, said cable extending through the longitudinal bores in the anchoring and sealing grommets, the diameter of the jacket being slightly larger than the diameter of the bore in the sealing grommet to provide a snug fit therebetween, the conductors of the cable extending through the polarized bores in the connector, and the bare ends of the conductors being electrically connected to respective ones of said sockets; and the tapered portion of the cap having substantially the same taper as that of the anchoring grommet, whereby said end cap upon being threadedly secured to said front portion of said sleeve exerting pressure on the anchoring grommet to thereby cause (i) the outer wall of said sealing grommet to seal off the connector chamber against outside moisture penetration, (ii) the diameter of the bore in the anchoring grommet to become reduced, and (iii) the portion of the cable's outer jacket, contained within the anchoring grommet's axial bore, to become anchored to said coupler body.

* * * * *